United States Patent [19]

Forrest, Sr. et al.

[11] Patent Number: 4,988,093

[45] Date of Patent: Jan. 29, 1991

[54] FLUID-FILLED NECK EXERCISER

[76] Inventors: Charles P. Forrest, Sr., 1306 St. Stephens Rd., Mobile, Ala. 36603; John L. Stump, 401 N. Section St., Fairhope, Ala. 36532

[21] Appl. No.: 467,171

[22] Filed: Jan. 19, 1990

[51] Int. Cl.[5] ..... A63B 23/025

[52] U.S. Cl. ..... 272/94; 272/119; 272/143; 2/413; 2/417

[58] Field of Search ..... 272/94, 116, 119, 130, 272/143; 152/510, 511, 512, 195; 264/315, 326; 2/177, 206, 413, 417, 418

[56] References Cited

U.S. PATENT DOCUMENTS

| | | | |
|---|---|---|---|
| 500,686 | 7/1893 | Corker | 272/94 |
| 1,047,212 | 12/1912 | Hamilton | 272/119 |
| 2,121,702 | 6/1938 | Larkin | 2/413 |
| 2,357,746 | 9/1944 | Kuss | 272/119 X |
| 2,594,478 | 4/1952 | Moore | 2/413 |
| 2,605,200 | 7/1952 | Iknayan | 152/572 X |
| 2,855,202 | 10/1958 | Kinne | 272/119 X |
| 3,124,353 | 3/1964 | Sharkey | 272/94 |
| 3,427,020 | 2/1969 | Montour et al. | 272/119 |
| 3,857,117 | 12/1974 | Tenowitz | 2/177 |
| 4,143,697 | 3/1979 | Igea et al. | 152/511 |
| 4,153,095 | 5/1979 | Sarkissian | 152/511 X |
| 4,218,780 | 8/1980 | Growe et al. | 2/206 X |
| 4,745,637 | 5/1988 | Steele et al. | 2/413 X |

FOREIGN PATENT DOCUMENTS

| | | | |
|---|---|---|---|
| 2031741 | 4/1980 | United Kingdom | 272/94 |

*Primary Examiner*—Robert Bahr
*Attorney, Agent, or Firm*—H. Jay Spiegel

[57] ABSTRACT

The fluid filled neck exerciser includes an annulus filled with a fluid such as water and/or air and a head support device. The head support device has attachment members allowing the removable attachment of the annulus, the head support device including adjustment structure allowing adjustment of the size of the head support device for heads of differing sizes. The annulus may be selectively filled with a desired amount of fluid and with the device placed on the head of the user, the head may be rotated to perform exercises such as rehabilitation therapy or muscle development. The fluid filled neck exerciser provides exercise for the entire cervical musculature by movement in predetermined patterns.

5 Claims, 11 Drawing Sheets

FLUID-FILLED NECK EXERCISER

BACKGROUND OF THE INVENTION

The present invention relates to an improved fluid filled neck exerciser. In the prior art, exercise devices designed to be placed on the head are known; however, no such device is known to Applicant which includes all of the structural features of the present invention and permits a full range of neck exercises utilizing substantially all of the muscles and joints associated with the neck.

The following prior art is known to Applicant:

U.S. Pat. No. 500,686 to Corker discloses a gravity helmet which may include an annulus designed to be filled with a substance to a desired degree to adjust the weight of the device. Corker does not teach or suggest the use of an annulus including a head supporting device.

U.S. Pat. No. 2,051,366 to Catron discloses an exercising apparatus wherein a helmet is provided with a central bearing on which may be hung a weight attached to an elongated cable. There is no teaching or suggestion by Catron of the use of an annulus at least partially filled with liquid.

U.S. Pat. No. 2,960,793 to Van Cleave discloses a device designed to be worn on the head and including a ball attached to a central bearing by an elongated cable. Again, Van Cleave does not contemplate the use of an annulus at least partially filled with liquid.

U.S. Pat. No. 3,502,335 to Sholin discloses a dome which may be placed on the head of the user and which includes grooves in which a small ball may rotate. Again, there is no teaching or suggestion of the use of an annulus with liquid contained therein.

U.S. Pat. No. 3,820,780 to Tarbox discloses a weighted headband designed to be worn on the head to strengthen the neck muscles which includes a band attached to the head by hook and pile fastening means and including chambers filled with weighted material There is no teaching or suggestion in Tarbox of movement of the weighted material about the device when the head is moved.

U.S. Pat. No. 4,468,023 to Solloway discloses an aquatic neck exercise device including an embodiment illustrated in FIGS. 22–27 designed to be worn on the head of the user. The device includes fins designed to interact with the water in a body of water for exercise purposes. This is different from the present invention.

U.S.S.R. Patent No. 1,227,211 to Rudenkov discloses a device designed to be worn on the head of the user and to be affixed there by a belt apparently fastened under the chin. The device includes a post 12 designed to receive weights 15 and includes tubular rings 2 filled with liquid and spheres 3. As disclosed, when the head is rotated, the spheres 3 move the tubes 2 with respect to the cylinder 12 to produce centrifugal forces which together with the weight 15 apply load to the neck. This is different from the teachings of the present invention wherein a single annulus is rigidly affixed to a head support rather than movable with respect thereto. Furthermore, Rudenkov does not disclose the adjustability of the head support disclosed therein.

SUMMARY OF THE INVENTION

The present invention overcomes the deficiencies found in the prior art discussed above and provides a new and improved fluid filled neck exerciser designed to be easily usable and to facilitate the performance of neck exercises. The present invention includes the following interrelated aspects and features:

(a) In a first aspect, the present invention includes an annulus of an inflatable material which includes a combination air and water valve such that the annulus may be selectively filled with fluid such as water or air or a combination of both to a desired degree.

(b) In combination with the annulus is a head supporting device which includes a plurality of annulus straps designed to be wrapped around the annulus through the use of closure means such as, for example, hook and pile fastening means. Of course, any desired fastener may be employed such as snaps, buttons and the like. The fasteners when so affixed attach the head supporting device in a fixed position with respect to the annulus.

(c) The head supporting device includes an adjustable head strap having the annulus strap fasteners attached thereto and extending around a head and within the annulus as so installed. The adjustable head strap has two ends connectable to one another in an adjustable manner to provide adjustability for heads of varying sizes. The ends of the adjustable head strap may be connectable to one another through elongated hook and pile fastening means allowing such adjustment.

(d) A crown strap is provided and is attached to the adjustable head strap substantially perpendicular thereto and is adjustable as to its length by virtue of a central division thereof with the resulting ends being attachable to one another through further elongated hook and pile fastening means. The crown strap is provided to allow adjustment for heads of differing heights and to define the extent to which the annulus may be lowered onto the head of the user.

(e) A chin strap is included and is attached to the inner surface of the adjustable head strap substantially perpendicular thereto and is adjustable as to its length in a similar manner as described for the crown strap.

(f) With the head strap, chin strap and crown straps being adjusted for the particular user's head and with the annulus being filled to the desired degree with a fluid, the device is placed on the head of the user and the head is rotated so that the fluid within the annulus will flow in the annulus with respect thereto to allow neck exercises to be performed.

(g) In another embodiment, the neck exerciser may include a head supporting device which includes an inflatable bladder that is attached to the inside of the annulus and may be inflated using an inflating device according to the head size of a user.

Accordingly, it is a first object of the present invention to provide an improved fluid filled inflatable neck exerciser.

It is a further object of the present invention to provide such a device having a fluid filled annulus supported on the head of the user by a head supporting device.

It is a yet further object of the present invention to provide such a head supporting device with adjustability for heads of varying sizes and configurations.

It is a still further object of the present invention to provide an improved neck exerciser having flexibility allowing performing of rehabilitative therapy or muscle development.

These and other objects, aspects and features of the present invention will be better understood from the following detailed description of the preferred embodiment when read in conjunction with the appended drawing figures.

SPECIFIC DESCRIPTION OF THE PREFERRED EMBODIMENTS

Figure 1:
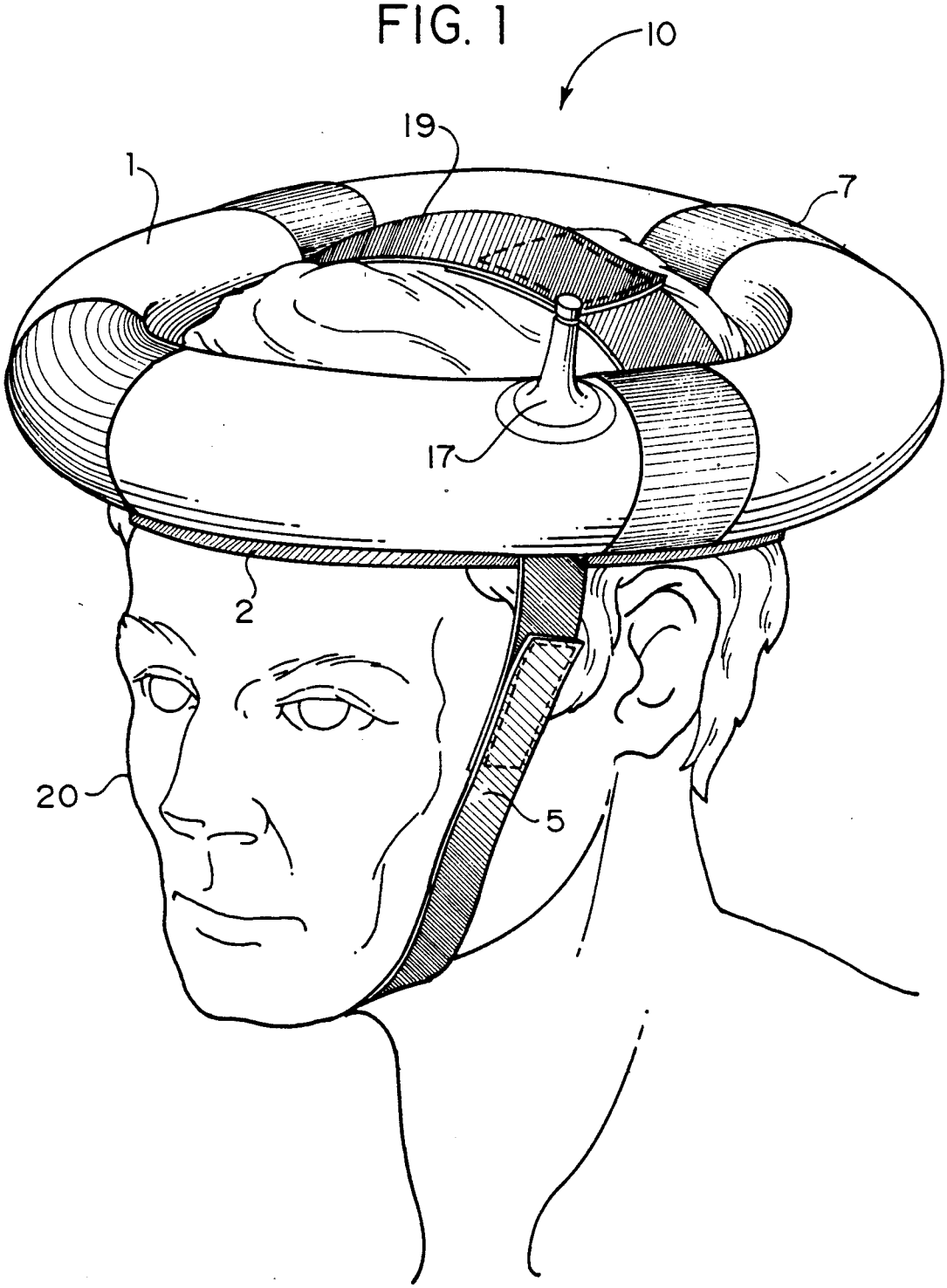
FIG. 1 shows the neck exerciser of the present invention as attached to the head of a user.

With reference firstly to FIG. 1, the improved neck exerciser is generally designated by the reference numeral 10 and is seen to include a man's head 20 having the neck exerciser attached thereto, an annulus 1, an adjustable head band 2, an adjustable chin strap 5, an adjustable crown strap 11, a plurality of annulus straps 7 and a valve means 17.

Figure 2:
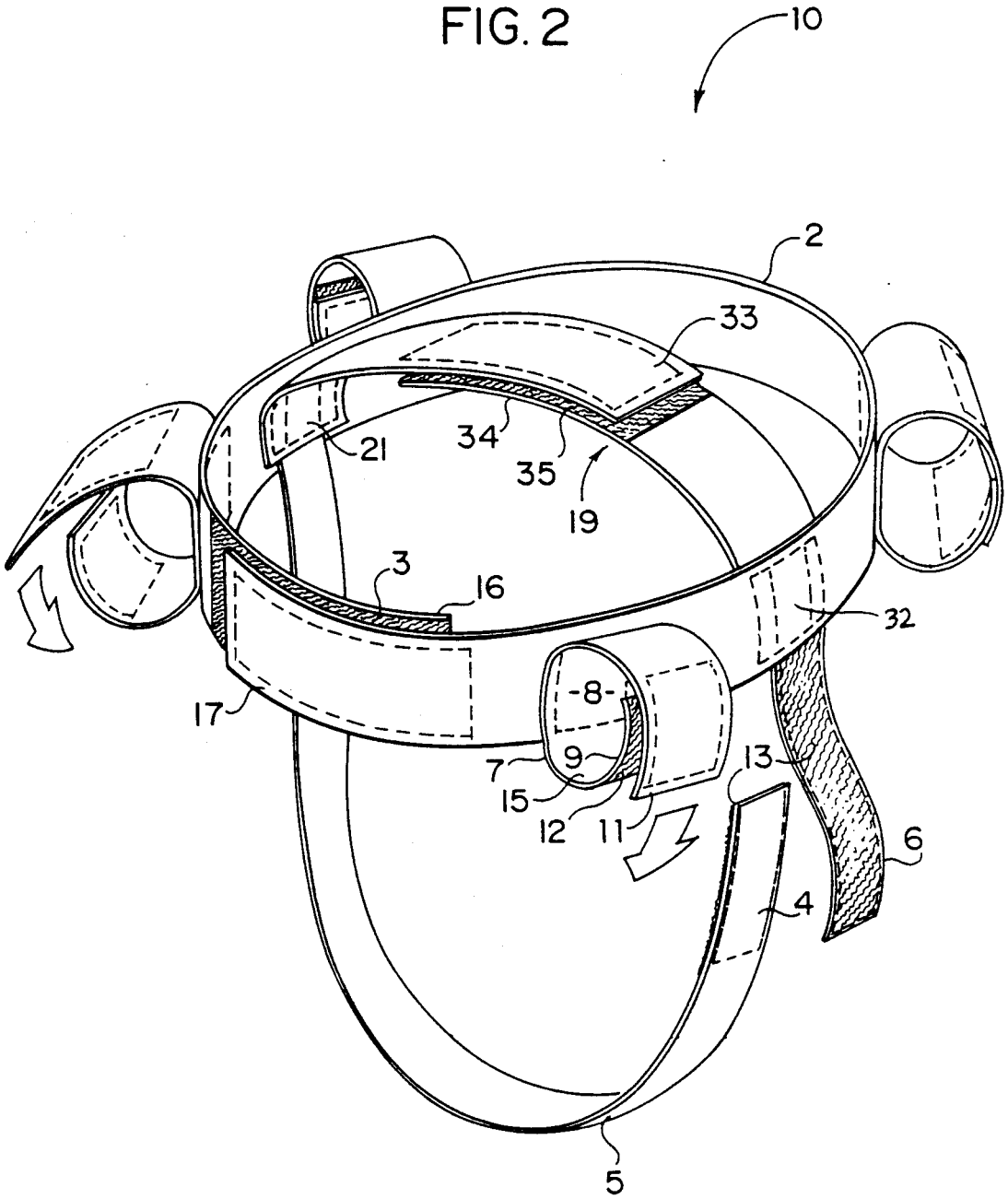
FIG. 2 shows a perspective view of the various attachment means of the neck exerciser.

FIG. 2 more clearly depicts the means by which the neck exerciser is attached to a person's head as well as how the annulus is attached to the various bands and straps. The annulus strap is denoted by reference numeral 7 having ends 9 and 11 and is attached to the adjustable head band 2 at reference numeral 8. The annulus strap also includes hook and pile fastening means 12 to facilitate securing the annulus 1 (not shown) to the adjustable head band 2 in the opening 15 of the annulus strap 7. In total, 4 annulus straps are attached at spaced intervals to the adjustable head band 2. The adjustable head band 2 having ends 16 and 17, respectively, is shown with hook and pile fastening means 3 to permit the head band to be adjusted to a person's head size. Also attached to the inner surface of adjustable head band 2 is a crown strap 19 and a chin strap 5 at reference numerals 21 and 32, respectively. The chin strap ends 4 and 6 have hook and pile fastening means 13 to allow adjustability for different size chins while the crown strap ends 33 and 34 have hook and pile fastening means 35 to permit adjustability for differing head heights.

The bands and strap material may be made of any material but a preferred material may include nylon. The fastening means as well as different adjustment straps and bands may be attached by stitching to each other. Of course, other means of attaching the various items to the band and strap materials may be utilized such as an adhesive.

Figure 3:
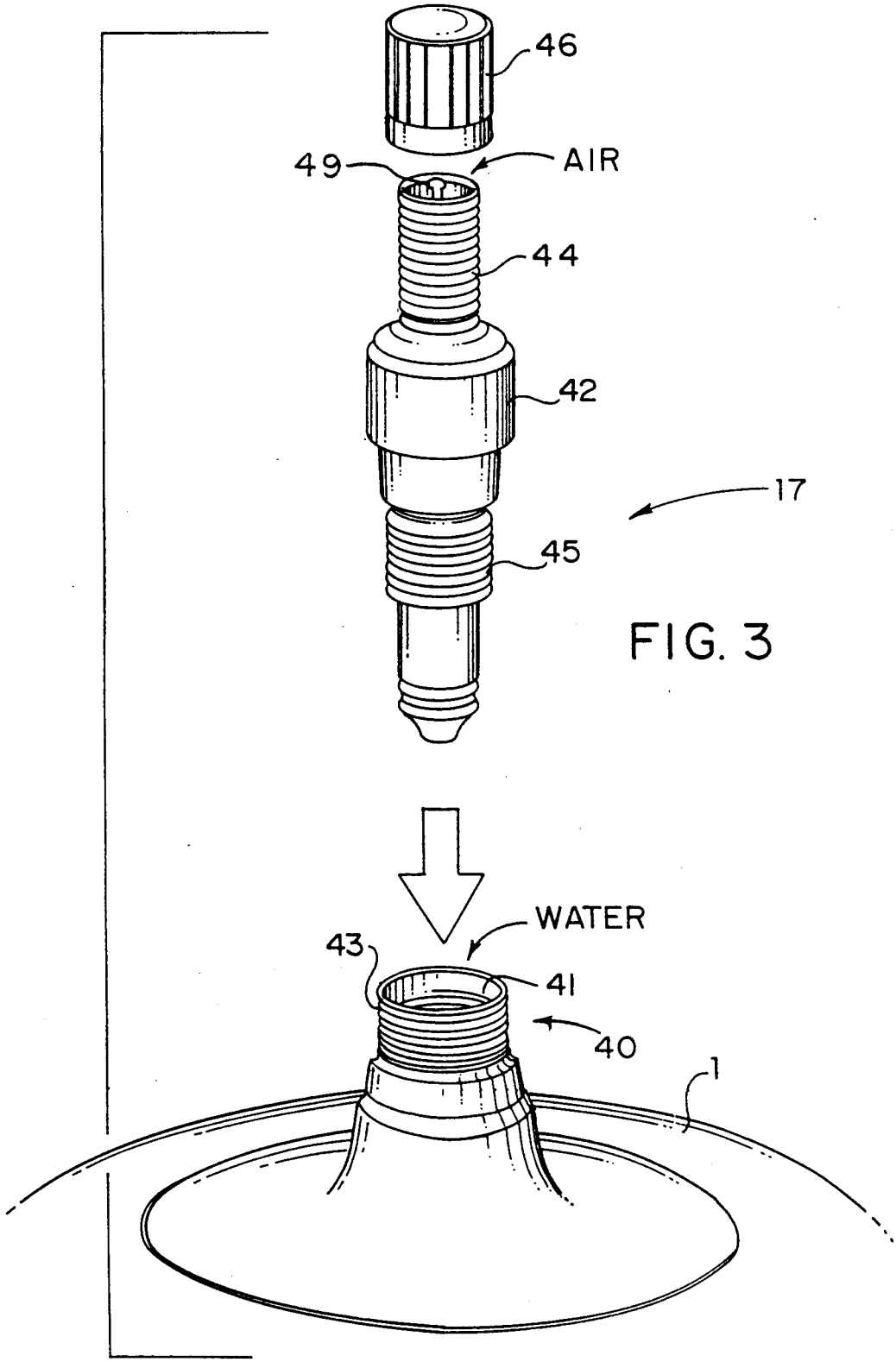
FIG. 3 shows an exploded view of the combination air-water valve of the neck exerciser.

FIG. 3 shows the valve 17 in exploded view to show greater detail and is seen to include port 40 having inner threads 41 and outer threads 43, an air valve 42 such as a tire-type valve having threaded portions 44 and 45, the threaded portion 45 being capable of being threaded to the stem 40 and threaded portion 44 being capable of being threaded into the valve cap 46. The valve cap 46 may be threaded onto an air valve threaded portion 44, or, if the air valve is removed, a valve cap, not shown, having a larger diameter may be threaded onto outer threads 43 of the port 40. Actuator stem 49 is designed to open the valve head (not shown) when depressed.

The annulus 1 may be made out of any inflatable material, preferably a rubber material. The dimensions of the annulus as well as the straps and bands associated therewith may also vary.

The valve 17 of the neck exerciser allows the annulus to be inflated with air or water, or a combination of both. To fill with water, the air valve 42 may be removed and the port 40 may be filled with water and sealed with a valve cap. Alternatively, the annulus may be inflated with air by using air valve 42 and a compressed air source or be manually inflated using the valve stem 40. In another mode, the annulus may be filled with a combination of water and air.

Figure 4:
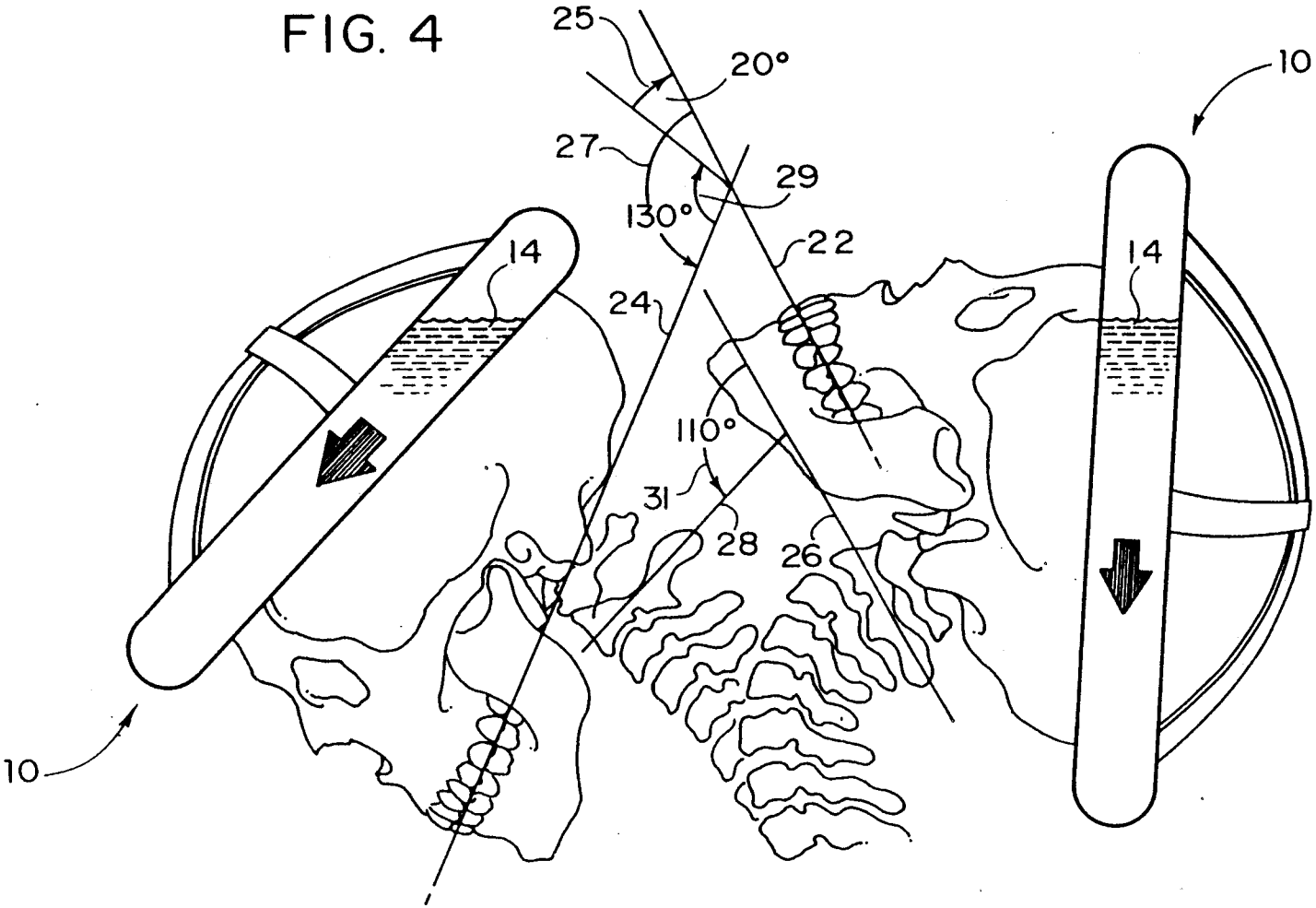
FIG. 4 shows the range of flexion and extension of the neck using &he neck exerciser.

FIG. 4 depicts the range of movement of the cervical spine using the neck exerciser of the present invention. It has been established that the cervical vertical column can move through a total range of 130° of flexion and extension wearing the neck exerciser, as measured between the plane of the bite 22 and 24, respectively, the angle depicted by reference numeral 27. The lower cervical column is extended in the range of 110° as measured by the plane 26 and 28, respectively, the angle being depicted by reference numeral 31. The range of flexion and extension of the suboccipital column is determined by subtraction of the two ranges aforementioned, and shown by the angle 20° depicted by reference numeral 25.

Figure 5:
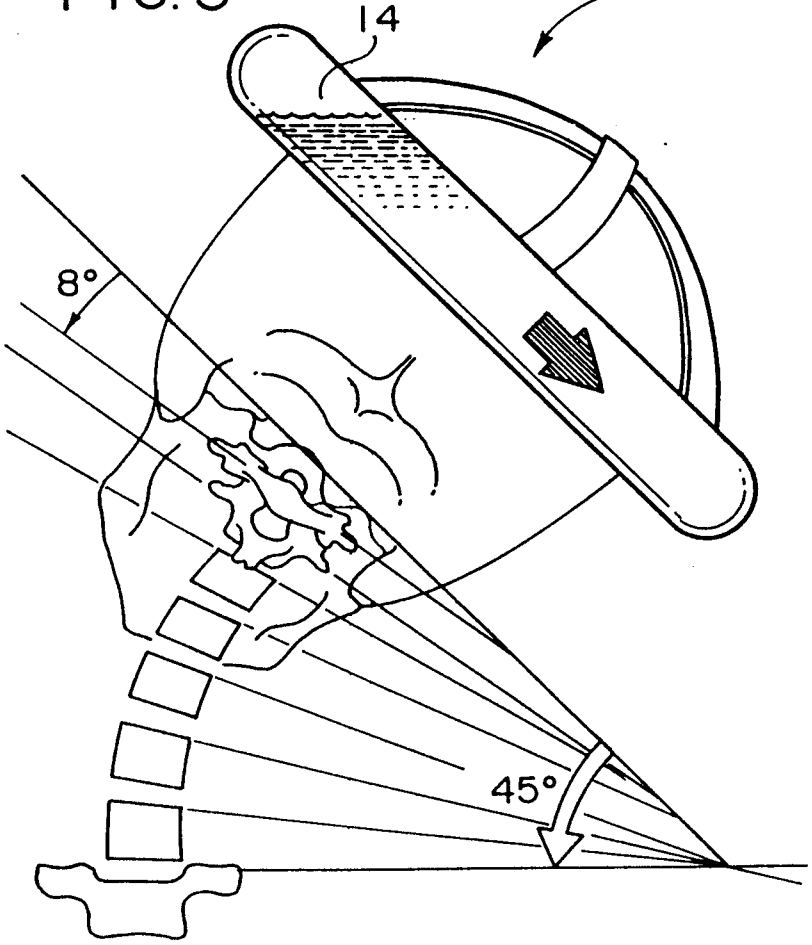
FIG. 5 shows the range of lateral flexion of the neck using the neck exerciser.

FIG. 5 shows a head in a lateral flexion position illustrating the total range of lateral flexion as 45°, thereby illustrating how the full range of flexion may be easily accomplished using the neck exerciser.

Figure 6:
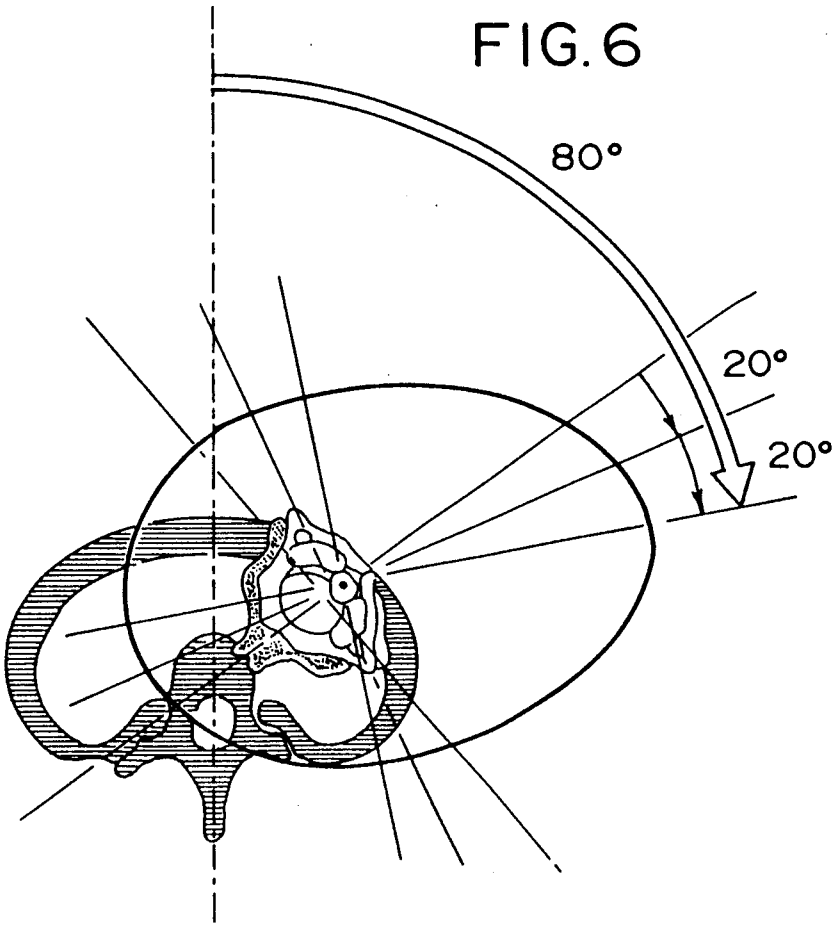
FIG. 6 shows a top view of the head and a range of rotation thereof.

FIG. 6 depicts a top view of a head showing a range of rotation as typically 80°. The total range of rotation for a head may vary from 80° to 90° on either side. Such rotation is easily accomplished when using the neck exerciser.

Figure 7:
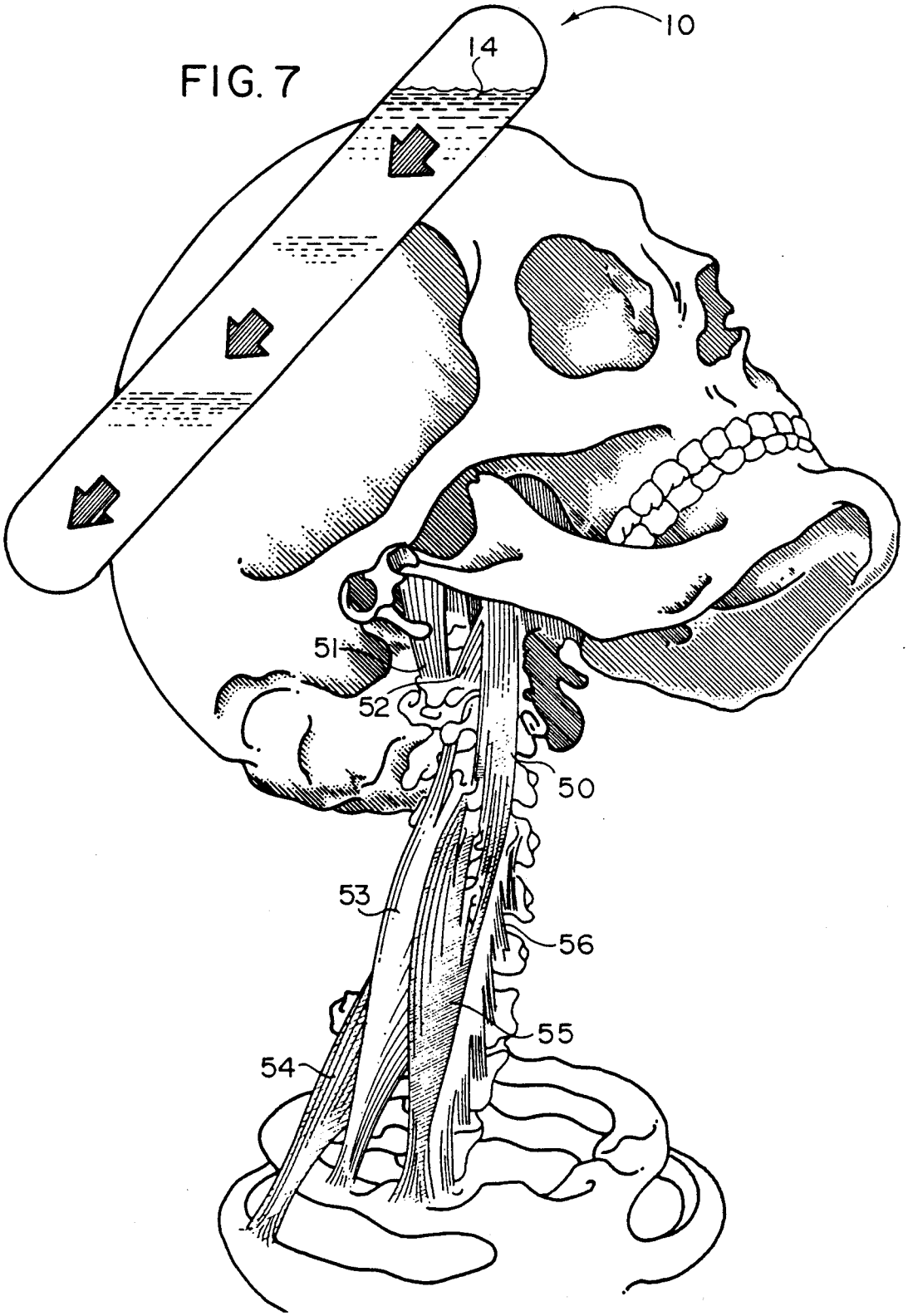
FIG. 7 shows the deep prevertebral muscles that are worked with the neck exerciser.

FIGS. 7 through 11 illustrate the various muscles that may be exercised using the improved neck exerciser. With reference to FIG. 7, the deep prevertebral muscles that may be worked with the neck exerciser are shown, i.e., the rectus capitis lateralis 51, the rectus capitis anterior minor 52, the scalenus medius 53, the scalenus posterior 54, the scalenus anterior 55, the longus cervicis 56, and the rectus capitis anterior major 50. The neck exerciser is especially beneficial in working these muscles since the head is allowed a full range of motion in the flexion, extension, lateral flexion and rotation movements.

Figure 8:
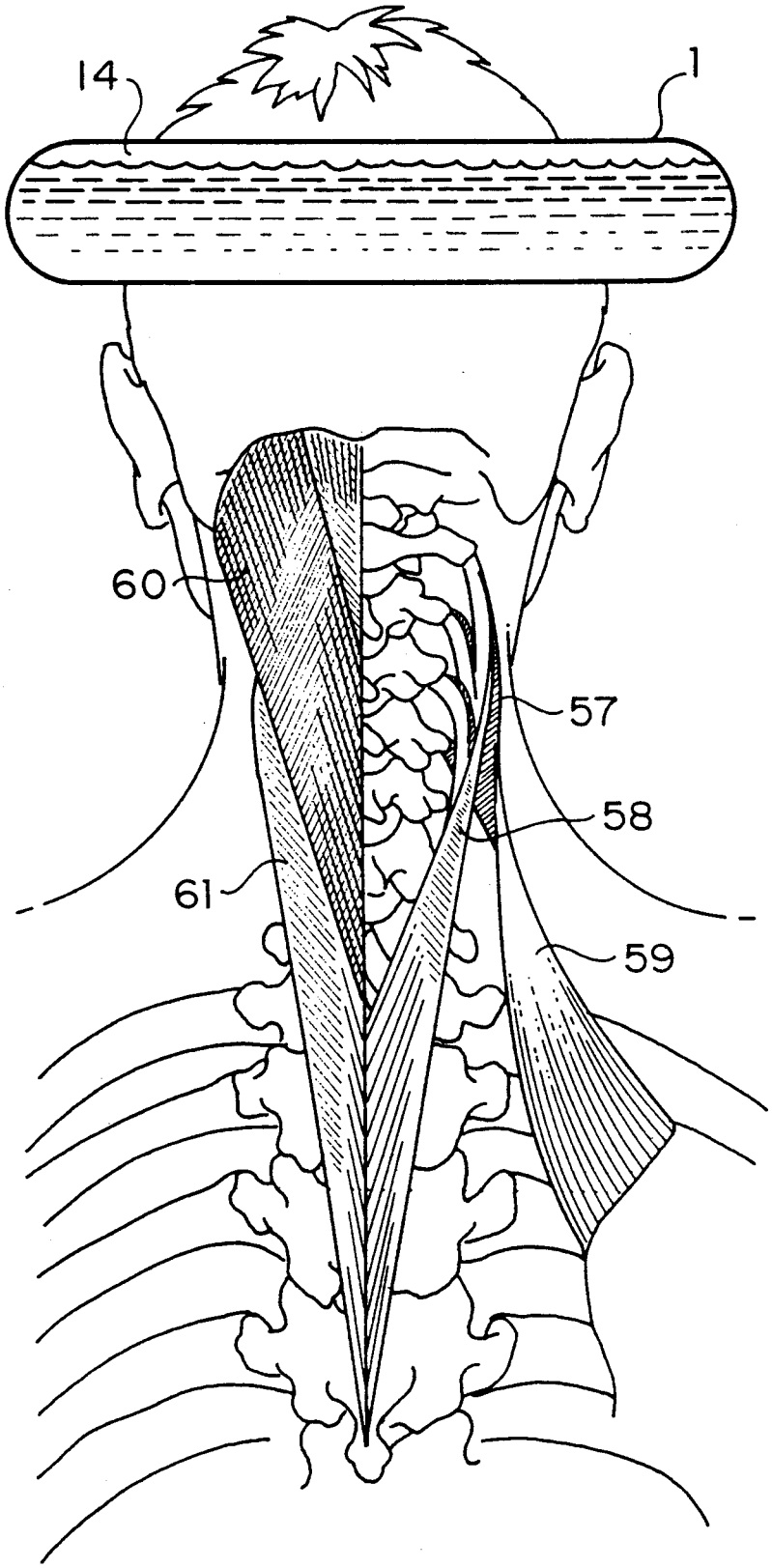
FIG. 8 shows some of the posterior muscles of the neck.
Figure 9:
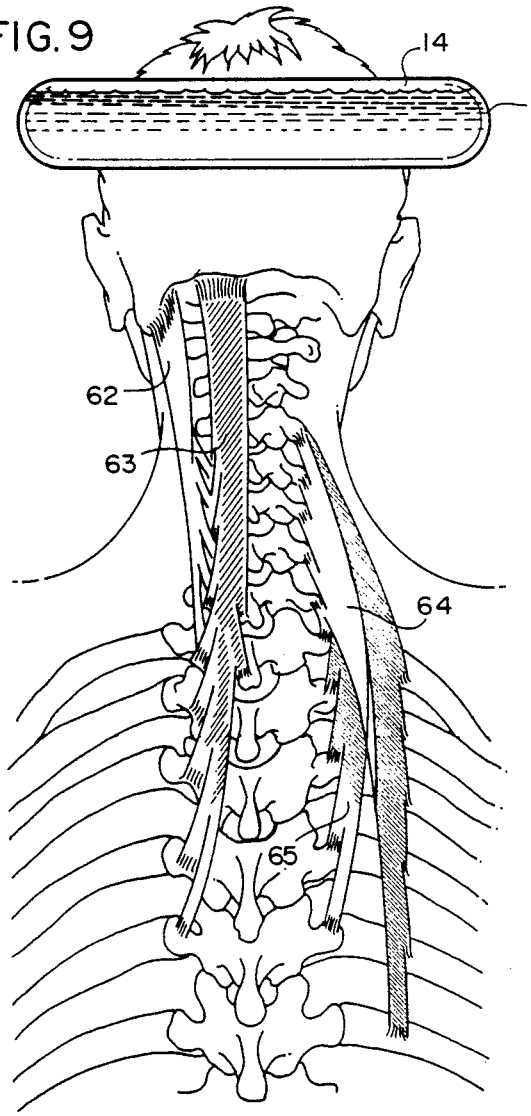
FIG. 9 shows additional posterior neck muscles that may be worked with the neck exerciser.

FIGS. 8 and 9 show some of the posterior neck muscles which extend the cervical column and the head and may be worked either bilaterally or unilaterally using the neck exerciser. FIG. 8 shows the semispinalis cervicis 57, the splenis cervicis 58, the levator scapulae 59, the splenis capitis 60, and splenis cervicis 61. With reference to FIG. 9, additional posterior neck muscles are shown including the longissimus capitis 62, the semispinalis capitis 63, the semispinalis cervicis 46 and the longissimus thoracis 65.

Figure 10:
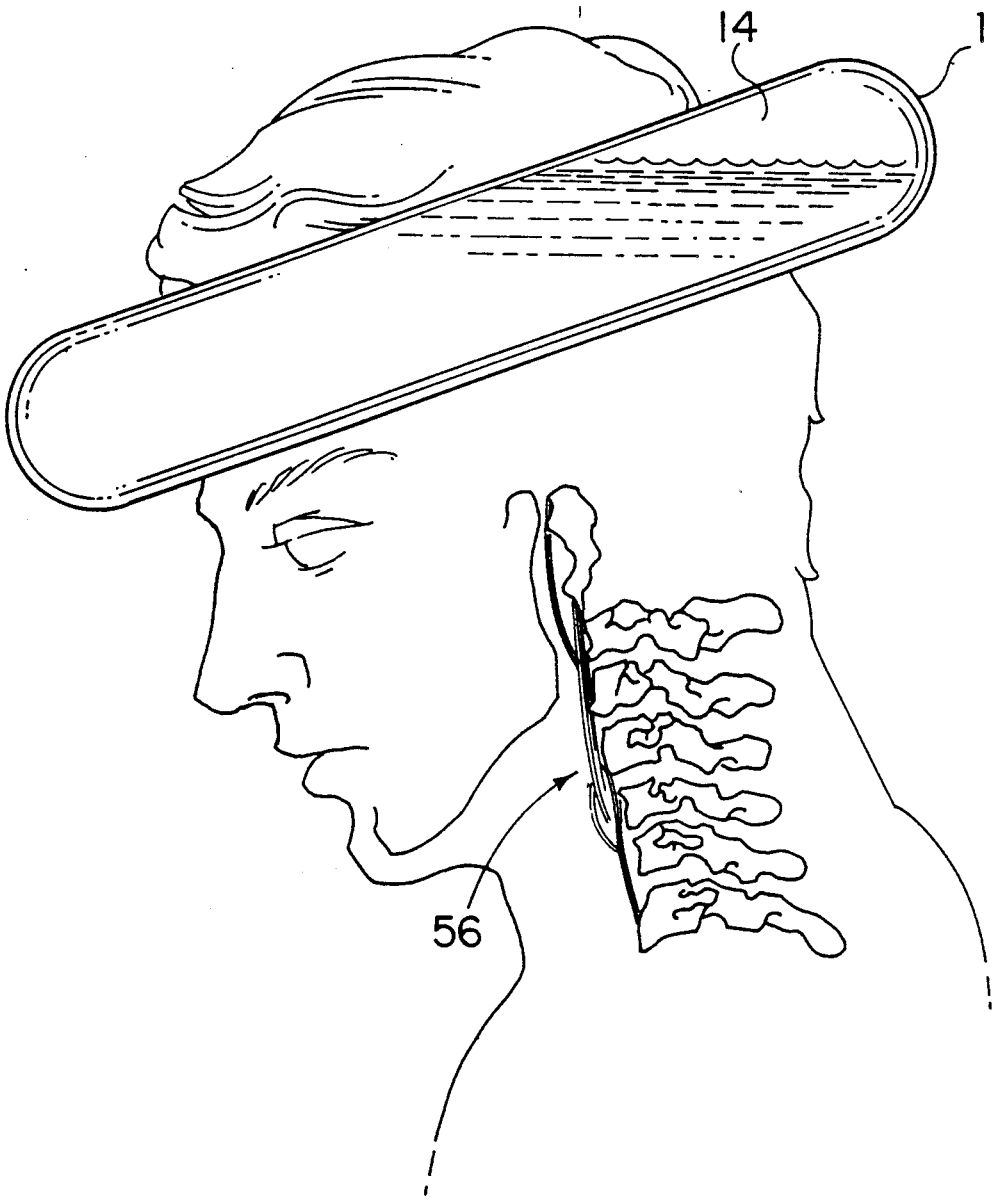
FIG. 10 shows an anterior neck muscle in use with the neck exerciser.

With reference to FIGS. 7 and 10, and the anterior neck muscles depicted therein, flexion of the head on the cervical column and flexion of the neck on the thoracic column depend on these muscles. In FIG. 7 the rectus anterior muscles, for example 50 and 52, produce flexion at the atlantoccipital joint with the longus cervicis muscle 56 producing flexion at the lower vertebral joints. The longus cervicis plays the most important role in strengthening the cervical column and holding it rigid. As such, exercising of this muscle with the neck exerciser is very beneficial.

Figure 11:
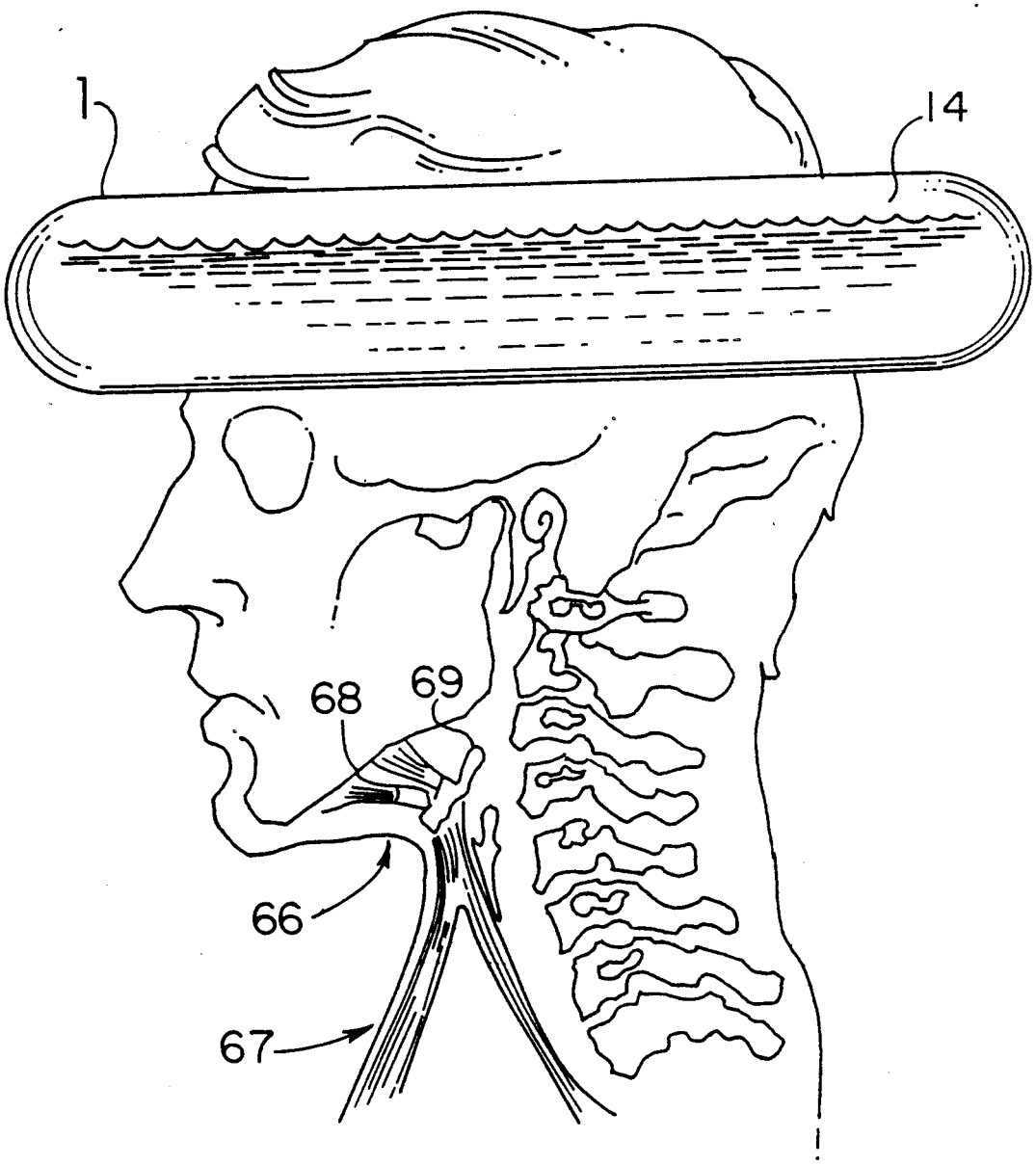
FIG. 11 shows additional anterior neck muscles as used with the neck exerciser.

FIG. 11 shows the anterior neck muscles, located at a distance from the cervical column, which act as a lever during flexion of the cervical column. The super-hyoid muscle 66 is attached to the mandible 68 and the hyoid bone 69, with the infra-hyoid muscle 67 also attached to the hyoid bone 69. These muscles are also very important in supporting the cervical column at rest and in flexion when using the neck exerciser.

As can be seen in FIGS. 4–11, the neck exerciser annulus 1 may be filled with a fluid 14 to a predetermined level to permit the neck exerciser to work the entire cervical musculature in its available range of motion, including flexion, extension, lateral extension and rotation by movement of the neck exerciser in predetermined patterns. The neck exerciser provides a variable resistance to muscle movement by the fluid contained therein, either a liquid, air, or a combination of both, thereby permitting the exercise of the entire musculature.

Figure 13:
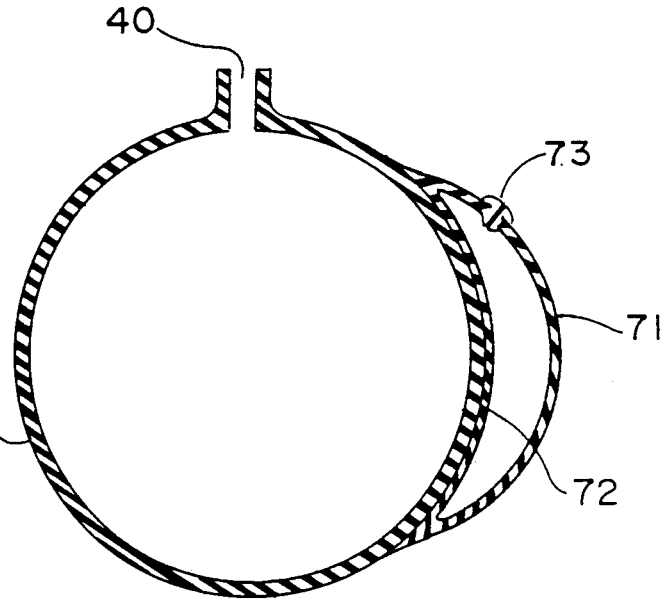
FIG. 13 shows a cross-sectional view along the line XIII—XIII of FIG. 12.
Figure 12:
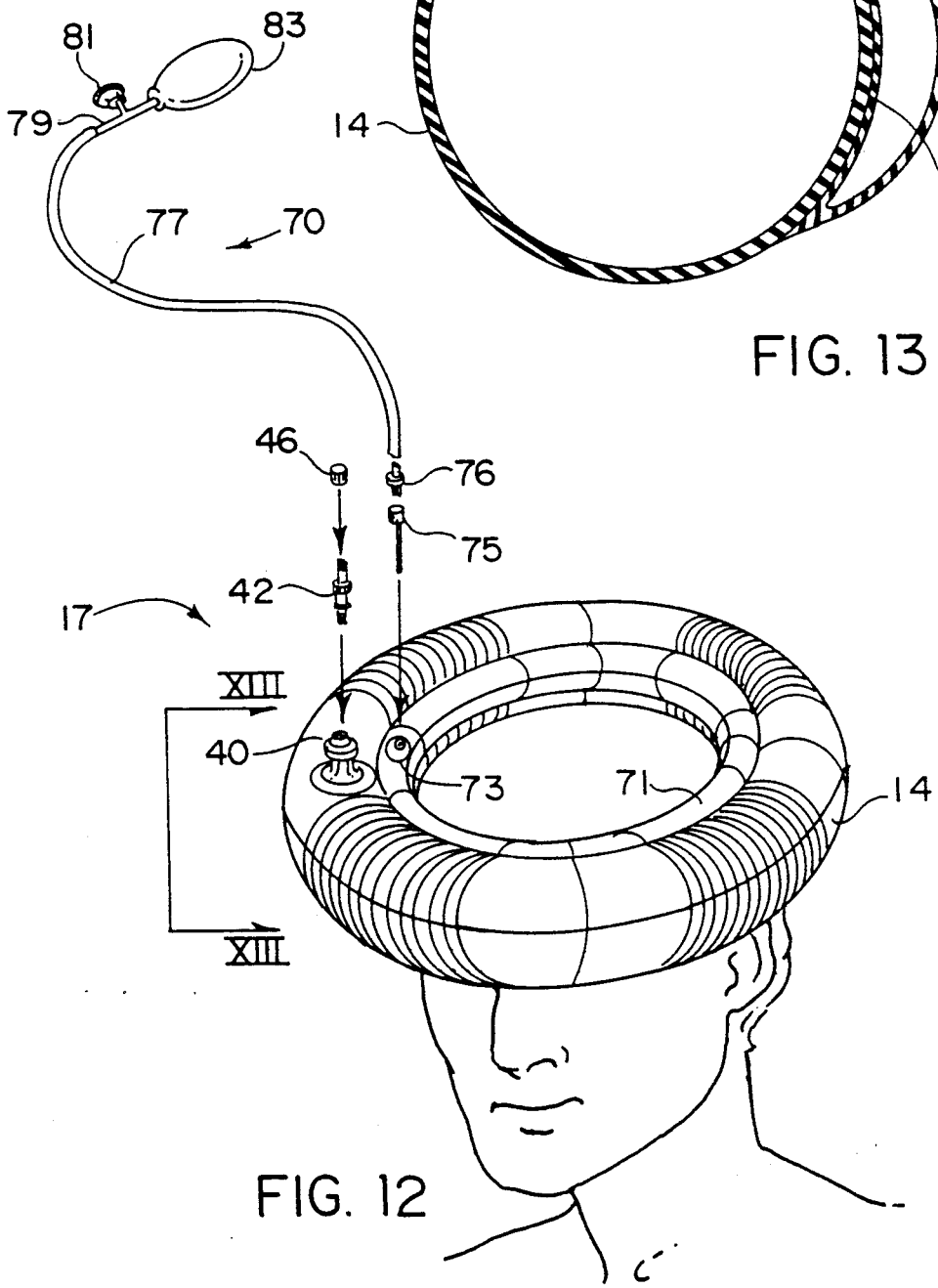
FIG. 12 shows another embodiment of the neck exerciser.

With reference to FIGS. 12 and 13, another embodiment of the improved neck exercise is illustrated and is seen to include an alternative means to make the neck exerciser adjustable for varying head sizes. As can be seen from FIGS. 12 and 13, the inflatable bladder 71 is attached on the surface of the inner portion of annulus 14, shown by the reference numeral 72. The bladder 71 may be attached to annulus 14 using an adhesive or other conventionally known attaching means. The bladder 71 is also seen to include a needle valve 73 which allows the adjustable inflation of the bladder 71 to fit the contours of an individual's head while using the neck exerciser.

FIG. 12 shows an exemplary inflating assembly designated by the reference numeral 70 which permits a user of the neck exerciser to adjustably inflate the bladder 71 to fit the head of a user. The inflating assembly 70 is seen to include a needle 75 which is adapted to fit into the needle valve 73, a hose 77, an inflating bulb 83, and coupling means 76 and 79. The coupling means 79 may also include an opening for relieving the pressure within the bladder 71 by the bleeder screw 81. Of course, other inflating assemblies as well as valve means in the bladder 71 may be utilized in the neck exerciser.

A pilot study was conducted to evaluate the efficacy of the improved neck exerciser in the improvement of neck flexibility, size and strength. Sixty-one high school football players meeting specific criteria were examined by a medical team and randomly assigned to one of two treatment groups. The group A treatment, administered by the team's athletic trainer, was composed of a friction-resistance type neck machine and their routine football exercises. The group B treatment was that of the improved neck exerciser, utilized in a specific program over an eight week period. Mean ages in the different groups ranged from 16 to 18 years. Pre-testing and Posttesting of the subjects was done. Flexibility was measured by a D-2LCD Gonimeter in measuring the cervical range of movement, flexion, extension, lateral flexion and rotation. The measurements were made with the subjects in a sitting position. Dynamic neck strength was measured using a Nicholas Manual Muscle Tester. Neck size was also recorded during pre- and post-testing. The continual interest of physicians, trainers, coaches and players in preventing and managing neck injury is evidenced by growing emphasis placed on head and neck safety in sports. The purpose of the pilot study was to evaluate the effectiveness of the neck exerciser based on flexibility, strength and size of the neck musculature. A two-month followup showed a significant difference. The subjects in the treatment group utilizing the traditional neck exercise methods showed 10% increase in flexibility, and no measurable increase in neck size. The group using the improved neck exerciser showed increases of 20% in flexibility and 35% in neck size. Neck size is significantly correlated to neck strength. This pilot study indicates there may be greater gain in neck size, strength and flexibility when utilizing the neck exerciser of the present invention as compared to traditional neck exercise devices.

Accordingly, the improved neck exerciser of the present invention, due to its unique feature of allowing both air and liquid to be utilized in all ranges of motion of the cervical spine, provides a neck exerciser that may be utilized both for rehabilitative exercising as well as for muscle development. All other prior art neck exerciser devices have not utilized such an inflated device toward the entire cervical musculature in its available range of motion, each time utilizing a variable resistance as determined by the amount of fluid in the neck exerciser at any given time.

The improved neck exerciser also permits ease of storage and transport because the annulus and bladder may be deflated or drained when the device is not in use and easily folded.

As such, an invention has been disclosed in terms of a preferred embodiment which fulfills each and every one of the objects of the invention as set forth hereinabove and provides a new and improved neck exerciser of great novelty and utility.

Of course, various changes, modifications and alternations in the teachings of the present invention may be contemplated by those skilled in the art without departing from the intended spirit and scope thereof. As such, it is intended that the present invention only be limited by the terms of the appended claims.

We claim:

1. An improved neck exercising device for exercising substantially the entire neck musculature comprising:

(a) a substantially flexible annular member having a first inner chamber, a fill port and a closure removably attachable over said fill port; and (b) a head supporting device further comprising an inflatable bladder adjacent said annular member, said inflatable bladder having a second inner chamber and an air valve means for adjustably inflating or deflating said inflatable bladder;

(c) wherein said first inner chamber is isolated from said second inner chamber during all modes of operation.

2. The invention of claim 1, further comprising an inflating device for adjustably inflating and deflating said inflatable bladder.

3. The invention of claim 2, further including a needle valve in said adjustable bladder, for receiving said inflating device.

4. The invention of claim 1, wherein said flexible annular member is made out of a rubber material.

5. The invention of claim 1, wherein said substantially flexible annular member includes an air valve, one end being removably attachable to said fill port and the other end adapted to receive said closure.

* * * * *